United States Patent [19]

Briggs, Jr. et al.

[11] 4,338,131

[45] Jul. 6, 1982

[54] NICKEL-BORON BINARY AMORPHOUS ALLOYS

[75] Inventors: James E. Briggs, Jr., Budd Lake; Ryusuke Hasegawa, Morristown, both of N.J.

[73] Assignee: Allied Corporation, Morristown, N.J.

[21] Appl. No.: 122,547

[22] Filed: Feb. 19, 1980

[51] Int. Cl.[3] ..... C22C 19/03

[52] U.S. Cl. ..... 148/403; 420/441

[58] Field of Search ..... 75/170; 148/32

[56] References Cited

U.S. PATENT DOCUMENTS 3,856,513 12/1974 Chen et al. ..... 75/170

*Primary Examiner*—R. Dean

*Attorney, Agent, or Firm*—Ernest D. Buff; Gerhard H. Fuchs

[57] ABSTRACT

Binary amorphous alloys of nickel and boron have high mechanical hardness and relatively low melting temperatures. The alloys have the formula $Ni_aB_b$, where "a" has values of about 81 to 82, 75 and 59 to 72 atom percent and "b" has values of about 18 to 19, 25 and 28 to 41 atom percent.

4 Claims, No Drawings

NICKEL-BORON BINARY AMORPHOUS ALLOYS

DESCRIPTION

BACKGROUND OF THE INVENTION

1. Field of the Invention

The invention is concerned with amorphous metal alloys and, more particularly, with amorphous metal alloys which include nickel plus boron.

2. Description of the Prior Art

Novel amorphous metal alloys have been disclosed and claimed by H. S. Chen and D. E. Polk in U.S. Pat. No. 3,856,513, issued Dec. 24, 1974. These amorphous alloys have the formula $M_aY_bZ_c$, where M is at least one metal selected from the group consisting of iron, nickel, cobalt, chromium and vanadium, Y is at least one element selected from the group consisting of phosphorus, boron and carbon, Z is at least one element selected from the group consisting of aluminum, antimony, beryllium, germanium, indium, tin and silicon, "a" ranges from about 60 to 90 atom percent, "b" ranges from about 10 to 30 atom percent and "c" ranges from about 0.1 to 15 atom percent. These amorphous alloys have been found suitable for a wide variety of applications, including ribbon, sheet, wire, powder, etc. Amorphous alloys are also disclosed and claimed having the formula $T_iX_j$, where T is at least one transition metal, X is at least one element selected from the group consisting of aluminum, antimony, beryllium, boron, germanium, carbon, indium, phosphorus, silicon and tin, "i" ranges from about 70 to 87 atom percent and "j" ranges from about 13 to 30 atom percent. These amorphous alloys have been found suitable for wire applications.

At the time these amorphous alloys were discovered, they evidenced mechanical properties that were superior to then-known polycrystalline alloys. Such superior mechanical properties included ultimate tensile strengths up to 350,000 psi ($2.41\times10^6$ kPa), hardness values of about 600 to 750 DPH and good ductility. Nevertheless, new applications requiring improved magnetic, physical and mechanical properties have necessitated efforts to develop further specific compositions.

With regard to methods of preparation, two general methods exist for preparing the amorphous metal alloys. The first method consists of procedures wherein atoms are added to an aggregate essentially one atom at a time. Such deposition procedures include vapor deposition, electrodeposition, chemical (electroless) deposition and sputtering.

The second method consists of procedures involving rapid quenching of a melt. Examples of such procedures include the various well-known "splat" techniques and continuous quenching techniques such as disclosed by J. Bedell in U.S. Pat. Nos. 3,862,658 and 3,863,700 and by S. Kavesh in U.S. Pat. No. 3,881,540. This second method is generally limited to materials which may be quenched to the amorphous state at rates less than about $10^7$°C./sec and more usually at rates of about $10^5$° to $10^6$°C./sec, which are attainable in presently available apparatus. The first method is more broadly applicable to all classes of metallic materials.

It has been suggested that a high degree of compositional complexity is essential in order to form amorphous metal alloys by quenching from the melt. See, e.g., B. C. Giessen and C. N. J. Wagner, "Structure and Properties of Noncrystalline Metallic Alloys Produced by Rapid Quenching of Liquid Alloys," in *Liquid Metals-Chemistry and Physics*, S. Z. Beer, Ed., pp. 633–695, Marcel Dekker Inc., New York (1972) and D. Turnbull, Vol. 35, *Journale de Physique*, Colloque-4, pp. C4-1-C4-10, 1974.

While some particular binary alloys of iron group metals have been made amorphous by some of the deposition methods, and by quenching from the melt (R. Ray and S. Kavesh U.S. Pat. No. 4,036,638) binary amorphous nickel-boron alloys with wide composition range have not been reported by quenching from the melt.

SUMMARY OF THE INVENTION

In accordance with the invention, binary amorphous alloys of nickel and boron, which are prepared by quenching from the melt, have high mechanical hardness and low melting points. The amorphous alloys consist essentially of the composition $Ni_aB_b$, where "a" has values of about 81 to 82, 75 and 59 to 72 atom percent and "b" has values of about 18 to 19, 25 and 28 to 41 atom percent.

The amorphous metal alloys of the invention evidence hardness values ranging from about 950 to 1320 kg/mm$^2$, crystallization temperatures ranging from about 280° to 470° C., mass density ranging from 7.47 to 8.41 g/cm$^3$, and melting temperatures ranging from 1000° to 1140° C.

The alloys of this invention are at least 50% amorphous, and preferably at least 80% amorphous and most preferably about 100% amorphous, as determined by X-ray diffraction.

The amorphous alloys in accordance with the invention are fabricated by a process which comprises forming a melt of the desired composition and quenching at a rate of at least about $10^5$°C./sec by casting molten alloy onto a chill wheel or into a quench fluid. Obtained physical and mechanical properties, together with a greater degree of amorphousness, are achieved by casting the molten alloy onto a chill wheel in a partial vacuum having an absolute pressure of less than about 5.5 cm of Hg.

DETAILED DESCRIPTION OF THE INVENTION

There are many applications which require that an alloy have, inter alia, a high mechanical hardness and ease of fabricability. For example, metal ribbons used in razor blade applications usually undergo a heat treatment of about 370° C. for about 30 minutes to bond an applied coating of polytetrafluoroethylene to the metal. Likewise, metal strands used as tire cord undergo a heat treatment of about 160° to 170° C. for about 1 hour to bond tire rubber to the metal.

When crystalline alloys are employed, phase changes can occur during heat treatment that tend to degrade the physical and mechanical properties. Likewise, when amorphous alloys are employed, a complete or partial transformation from the glassy state to an equilibrium or a metastable crystalline state can occur during heat treatment. As with inorganic oxide glasses, such a transformation degrades physical and mechanical properties such as ductility, tensile strength, etc.

The thermal stability of an amorphous metal alloy is an important property in certain applications. Thermal stability is characterized by the time-temperature transformation behavior of an alloy, and may be determined in part by DTA (differential thermal analysis). As considered here, relative thermal stability is also indicated by the retention of ductility in bending after thermal treatment. Alloys with similar crystallization behavior as observed by DTA may exhibit different embrittlement behavior upon exposure to the same heat treatment cycle. By DTA measurement, crystallization temperatures, $T_c$, can be accurately determined by slowly heating an amorphous alloy (at about 20° to 50° C./min) and noting whether excess heat is evolved over a limited temperature range (crystallization temperature) or whether excess heat is absorbed over a particular temperature range (glass transition temperature). In general, the glass transition temperature $T_g$ is near the lowest, or first, crystallization temperature, $T_{c1}$, and, as is convention, is the temperature at which the viscosity ranges from about $10^{13}$ to $10^{14}$ poise.

Most amorphous metal alloy compositions containing iron, nickel, cobalt and chromium which include phosphorus, among other metalloids, evidence values of mechanical hardness of about 800 to 1290 kg/mm$^2$ and crystallization temperatures of about 300° to 490° C. For example, an amorphous alloy having the composition $Fe_{80}P_{16}C_3B_1$ has a hardness of about 835 kg/mm$^2$ and a crystallization temperature of about 330° C. The binary $Fe_{80}B_{20}$ amorphous alloy has a hardness of 1100 kg/mm$^2$ and a crystallization temperature of 465° C. The highest value of hardness for transition metal-metalloid binary amorphous alloy was observed on amorphous $Fe_{75}B_{25}$ alloy and was 1290 kg/mm$^2$.

Some thermodynamic parameters such as the melting temperature of the alloy is important in some applications including brazing. Previously obtained binary Fe-B and Co-B amorphous have melting temperatures ranging from about 1150° to 1300° C. In the case of brazing applications, lower melting temperature is obviously advantageous.

In accordance with the invention, binary amorphous alloys of nickel and boron have high mechanical hardness and low melting temperatures. These amorphous metal alloys consist essentially of the composition $Ni_aB_b$, where "a" has values of about 81 to 82, 75 and 59 to 72 atom percent and "b" has values of about 18 to 19, 25 and 28 to 41 atom percent. Examples of amorphous alloy compositions in accordance with the invention include $Ni_{59}B_{41}$, $Ni_{72}B_{28}$, $Ni_{75}B_{25}$ and $Ni_{81.5}B_{18.5}$. The purity of all compositions is that found in normal commercial practice.

The amorphous metal alloys in accordance with the invention typically evidence hardness values ranging from about 950 to 1320 kg/mm$^2$ and crystallization temperatures ranging from about 280° to 470° C. These amorphous metal alloys have relatively low melting temperatures (1000°–1140° C.).

A further surprising result is that the amorphous alloys of the invention can be formed by cooling a melt at a rate of at least about $10^5$°C./sec. A variety of techniques are available, as is now well-known in the art, for fabricating splat-quenched foils and rapid-quenched continuous ribbons, wire, sheet, etc. Typically, a particular composition is selected, powders of the requisite elements (or of materials that decompose to form the elements, such as nickel-borides, etc.) in the desired proportions are melted and homogenized, and the molten alloy is rapidly quenched either on a chill surface, such as a rotating cooled cylinder, or in a suitable fluid medium, such as a chilled brine solution. The amorphous alloys may be formed in air. However, superior mechanical properties are achieved by forming these amorphous alloys in a partial vacuum with absolute pressure less than about 5.5 cm of Hg, and preferably about 100 μm to 1 cm of Hg, as disclosed in U.S. Pat. No. 4,154,283 to Ray et al.

The amorphous metal alloys are at least 50% amorphous, and preferably at least 80% amorphous, as measured by X-ray diffraction. However, a substantial degree of amorphousness approaching 100% amorphous is obtained by forming these amorphous metal alloys in a partial vacuum. Ductility is thereby improved, and such alloys possessing a substantial degree of amorphousness are accordingly preferred.

Ribbons of these alloys find use in brazing applications and in applications requiring relatively high thermal stability and increased mechanical strength.

EXAMPLE

Rapid melting and fabrication of amorphous strips of ribbons of uniform width and thickness from high melting (about 1300° to 1400° C.) reactive alloys was accomplished under vacuum. The application of vacuum minimized oxidation and contamination of the alloy during melting or squirting and also eliminated surface damage (blisters, bubbles, etc.) commonly observed in strips processed in air or inert gas at 1 atm. A copper cylinder was mounted vertically on the shaft of a vacuum rotary feedthrough and placed in a stainless steel vacuum chamber. The vacuum chamber was a cylinder flanged at two ends with two side ports and was connected to a diffusion pumping system. The copper cylinder was rotated by variable speed electric motor via the feedthrough. A crucible surrounded by an induction coil assembly was located above the rotating cylinder inside the chamber. An induction power supply was used to melt alloys contained in crucibles made of fused quartz, boron nitride, alumina, zirconia or beryllia. The amorphous ribbons were prepared by melting the alloy in a suitable nonreacting crucible and ejecting the melt by over-pressure of argon through an orifice in the bottom of the crucible onto the surface of the rotating (about 1500 to 2000 r/min) cylinder. The melting and squirting were carried out in a partial vacuum of about 100 μm, using an inert gas such as argon to adjust the vacuum pressure.

Using the vacuum-melt casting apparatus described above, a number of various glass-forming nickel-boron base alloys were chill cast as continuous ribbons having substantially uniform thickness and width. Typically, the thickness ranged from 25 to 50 μm and the width ranged from 0.2 to 1.5 cm. The ribbons were checked for amorphousness by X-ray diffraction and DTA. Hardness (DPH) was measured by the diamond pyramid technique, using a Vickers-type indenter consisting of a diamond in the form of a square-based pyramid with an included angle of 136° between opposite faces.

Mechanical Properties

The hardness (in kg/mm$^2$), crystallization temperature (in °C.) and mass density of several of the amorphous metal alloys are listed in Table I below.

TABLE I

| Alloy Composition (Atom Percent) | Hardness (kg/mm$^2$) | Mass Density (g/cm$^3$) | Crystallization Temperature (°C.) |
|---|---|---|---|
| $Ni_{82}B_{18}$ | 950 | 8.41 | 277 |
| $Ni_{81.5}B_{18.5}$ | 980 | 8.42 | 286 |
| $Ni_{81}B_{19}$ | 960 | 8.39 | 270 |

TABLE I-continued

| Alloy Composition (Atom Percent) | Hardness ($kg/mm^2$) | Mass Density ($g/cm^3$) | Crystallization Temperature (°C.) |
|---|---|---|---|
| $Ni_{75}B_{25}$ | 1140 | 7.90 | 397 |
| $Ni_{70}B_{30}$ | 1200 | 7.93 | 361 |
| $Ni_{68}B_{32}$ | 1225 | 7.85 | 417 |
| $Ni_{65}B_{35}$ | 1250 | 7.91 | 471 |
| $Ni_{62}B_{38}$ | 1290 | 7.72 | 447 |
| $Ni_{60}B_{40}$ | 1320 | 7.47 | 424 |

What is claimed is:

1. A binary metal alloy that is at least 50% amorphous having mechanical hardness ranging from about 950 to 1320 $kg/mm^2$ and melting temperatures ranging from about 1000°-1140° C., characterized in that the alloy consists of the binary composition $Ni_2B_b$, where "a" has values of about 81 to 82, 75 and 59 to 72 atom percent and "b" has values of about 18 to 19, 25 and 28 to 41.

2. The amorphous metal alloy of claim 1 in which the alloy consists essentially of a composition selected from the group consisting of $Ni_{81.5}B_{18.5}$, $Ni_{75}B_{25}$, $Ni_{72}B_{28}$ and $Ni_{59}B_{41}$.

3. The amorphous metal alloy of claim 1 in which the alloy is at least 80% amorphous.

4. The amorphous metal alloy of claim 1 in which the alloy is at least 100% amorphous.

* * * * *